US005844483A

United States Patent [19]

Boley

[11] Patent Number: 5,844,483

[45] Date of Patent: Dec. 1, 1998

[54] GOLF EQUIPMENT INVENTORY DEVICE

[76] Inventor: Jeffrey V. Boley, 69 Kings Hwy. North, Westport, Conn. 06880

[21] Appl. No.: 895,705

[22] Filed: Jul. 17, 1997

[51] Int. Cl.[6] ..... G08B 21/00

[52] U.S. Cl. ..... 340/568; 206/315.3; 340/539; 340/540; 340/572; 340/691

[58] Field of Search ..... 340/568, 540, 340/572, 539, 691; 206/315.3, 315.6

[56] References Cited

U.S. PATENT DOCUMENTS

| | | | |
|---|---|---|---|
| 5,252,948 | 10/1993 | Goris et al. | 340/539 |
| 5,341,125 | 8/1994 | Plonsky et al. | 340/572 |
| 5,444,223 | 8/1995 | Blama | 235/435 |
| 5,517,195 | 5/1996 | Narlow et al. | 342/51 |
| 5,534,682 | 7/1996 | Graef et al. | 235/379 |
| 5,546,196 | 8/1996 | Huot et al. | 358/527 |
| 5,565,845 | 10/1996 | Hara | 340/568 |
| 5,591,951 | 1/1997 | Doty | 235/435 |
| 5,594,420 | 1/1997 | Copeland et al. | 340/572 |
| 5,608,379 | 3/1997 | Narlow et al. | 340/572 |
| 5,626,531 | 5/1997 | Little | 473/353 |
| 5,682,143 | 10/1997 | Brady et al. | 340/572 |
| 5,686,882 | 11/1997 | Giani | 340/539 |

*Primary Examiner*—Glen Swann
*Attorney, Agent, or Firm*—Robert M. Rauker

[57] ABSTRACT

A device to monitor golf club location includes a marker mechanism, positionable on a golf club that imparts a unique identification to the club. The device also includes sensing mechanisms for sensing removal and return of the golf club into or out of a bag by sensing a change with respect to the marker. The device also includes a readout mechanism that receives a signal from the sensing mechanisms and transmits the status to the golfer.

12 Claims, 4 Drawing Sheets

GOLF EQUIPMENT INVENTORY DEVICE

BACKGROUND OF THE INVENTION

The present invention relates to a device for monitoring a golf equipment inventory in a bag or on a golf course and to a method for keeping an inventory of golf equipment.

One common and expensive problem encountered by golfers occurs when a golfer pulls several clubs from a golf bag in order to ascertain the best club for a shot. At this time, the golfer is not certain of which club is most appropriate until the golfer has studied all of the conditions. Eventually, the golfer selects an appropriate club and drops the other clubs on the ground in order to take his stroke. After making the stroke, the golfer picks up the bag, oblivious in many instances, to the fact that one or more of his or her clubs are still positioned on the ground. The golfer's forgetfulness becomes apparent when he or she has occasion to select a club he or she has forgotten, only to find it is not in the bag. At this point, the golfer must either retrace his steps, traveling backwards through the course until finding the club, or the golfer must play the rest of the round of golf without the club.

SUMMARY OF THE INVENTION

The golf equipment inventory device of the present invention, positionable in or on a golf bag, includes a marker mechanism positionable within a grip shaft of a golf club. The marker mechanism includes an identification medium unique to a particular golf club. The device further includes one or more mechanisms for sensing removal and return of the golf club from the golf bag by sensing a change in presence of the marker. Each of the mechanisms for detecting a change in the marker presence transmits a signal to a readout mechanism.

The present invention also includes a marker for identifying a golf club to a sensor. The marker includes a shaft and an end portion attached to the shaft. The marker is positionable in a shaft of a golf club.

DETAILED DESCRIPTION OF PREFERRED EMBODIMENTS

Figure 1:
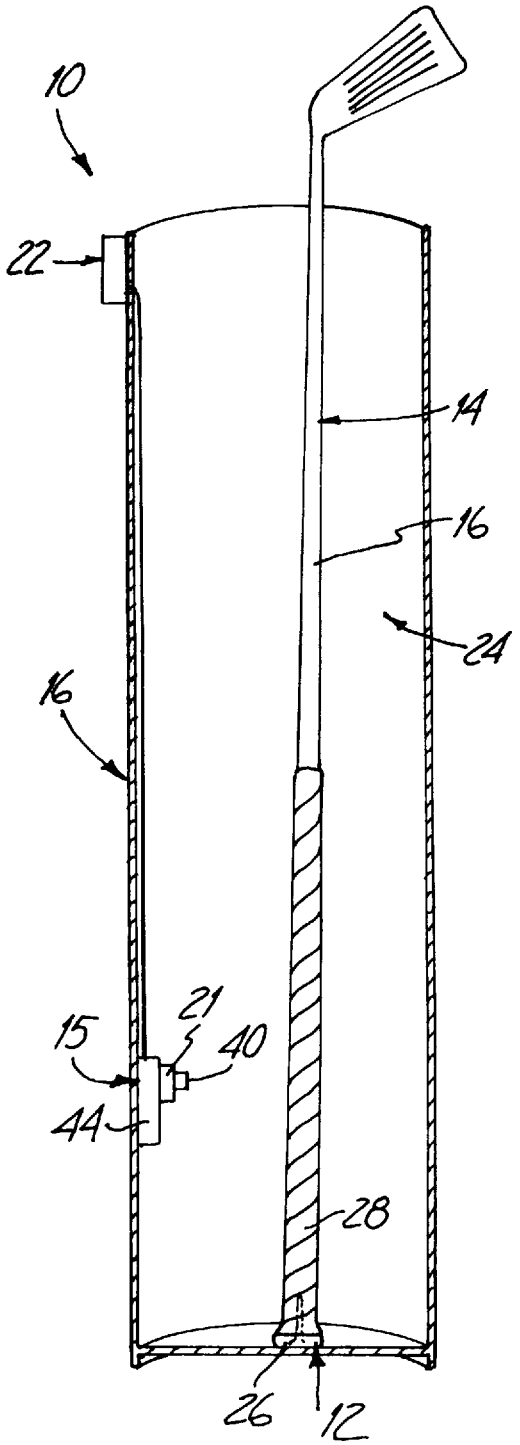
FIG. 1 is a cross-sectional view of one embodiment of the golf equipment inventory device of the present invention installed on a golf bag wherein the device is installed inside of a golf bag.

The golf equipment inventory device of the present invention, illustrated in one embodiment at 10 in FIG. 1 includes a marker mechanism 12 positioned within a golf club 14 wherein the marker mechanism 12 encloses or otherwise contains a unique identification for each club 14. The inventory device 10 further includes a sensing mechanism 15 that senses a removal of a specific golf club 14 from a golf bag 24 as well as return of the golf club 14 into the bag 24. The inventory device 10 additionally includes a readout 22 that receives signals from the sensing mechanism 15 and that provides information to the golfer regarding clubs that have been removed from and returned to the golf bag 24.

The inventory device 10 of the present invention permits the golfer to concentrate on the game of golf rather than concentrating on the location of his or her golf clubs. The inventory device 10 of the present invention does not require the golfer to change his or her actions regarding removal of a golf club 14 from a bag 24 or placement of the club into the bag 24. The device 10 accommodates the natural movements of the golfer in order to track the presence or absence of golf clubs 14 with respect to the golf bag 24 and to report this status to the golfer through the readout 22. Further, the device 10 may be used with any conventional golf club 14 having a shaft 16 terminating at a butt end 26 and having a grip 28.

Each golf club 14 within the golfer's inventory is fitted with the marker 12 affixed within the butt end 26 of each golf club at the grip 28. Each marker 12 encloses or otherwise contains a unique and identifying code readable by the sensing mechanism 15 for identifying the club's identity as well as the club's presence within or outside of the golf bag 24. The code is, in one embodiment, embodied by a magnetic strip 17 having magnetic information (FIG. 3).

Figure 3:
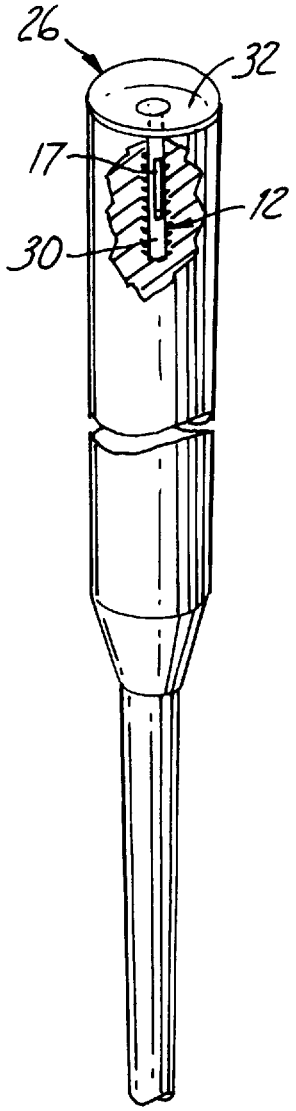
FIG. 3 is one cross-sectional view of a golf club marker mechanism positioned within a golf club.
Figure 4:
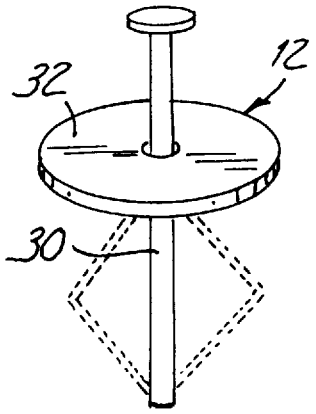
FIG. 4 is a perspective view of one embodiment of the golf club marker mechanism of the present invention.
Figure 6:
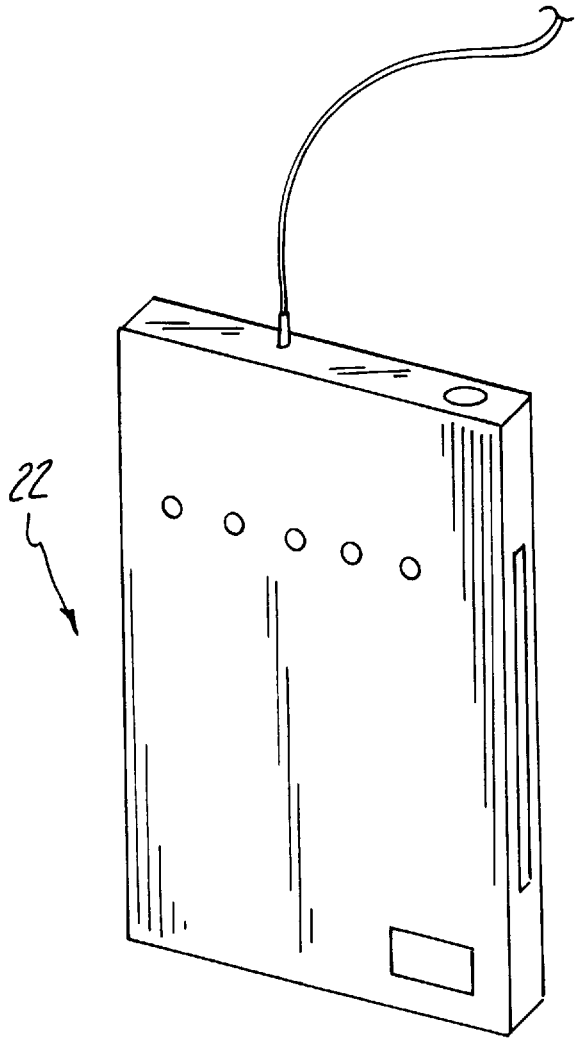
FIG. 6 is a perspective view of one embodiment of the golf club readout mechanism.

As seen in FIGS. 3 & 4, the marker 12 includes a push shaft element 30 and an end element 32 positioned on the shaft 30 at one end of the marker 12 for concealing and protecting the marker 12 from the elements once the marker 12 has been installed in the grip 28 of the golf club 14. In one embodiment, the push shaft 30 contains the unique identifying code in the form of a the strip of magnetic media 17. In particular, magnetic media 17 is encased within the push shaft 30 that is inserted in the club grip 28. It is also contemplated that the magnetic strip 17 may be supported by the shaft 30 on the marker 12 or adhered to the shaft 30 on the marker 12 with an adhesive.

The marker 12 is preferably made of a polymeric material, such as polypropylene. However, metallic or cellulose based materials may also be used to make the marker 12. The marker 12 may be made of a solid material or may be hollow.

Figure 5:
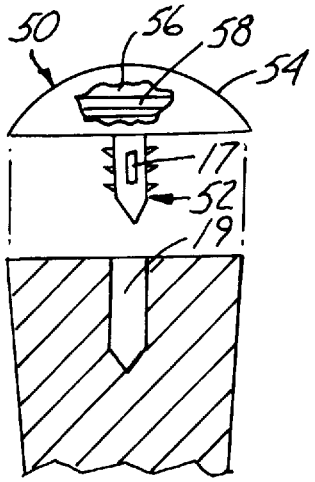
FIG. 5 is a perspective view of one other embodiment of the golf club marker mechanism of the present invention.

One preferred embodiment of the marker is illustrated at 50 in FIG. 5. The marker 50 includes a push shaft 52 and an end element 54 positioned on the push shaft 52. The marker 50 is constructed of plastic that is sufficiently reversibly deformable to fold as necessary to pass through a hole in the golf club 14 but to return to its original form once in place. For the marker 50, the end element 54 encloses an orifice 56 to permit insertion of magnetic media 58 into the end element 54.

The sensing mechanism 15 includes a magnetic reader module 21 for generating magnetic strip information signals from the unique magnetic media 17 or 58 of each marker 12 or 50 attached to each club 14. The magnetic reader module 21 includes a magnetic/charge head assembly 40 that charges and reads the magnetic information encoded on the magnetic strip 17 or 58 in each marker 12 or 50. Conventional head assemblies are known and disclosed in U.S. Pat. Nos. 5,034,836; 5,041,933; 5,274,522; and 5,285,324.

Figure 2:
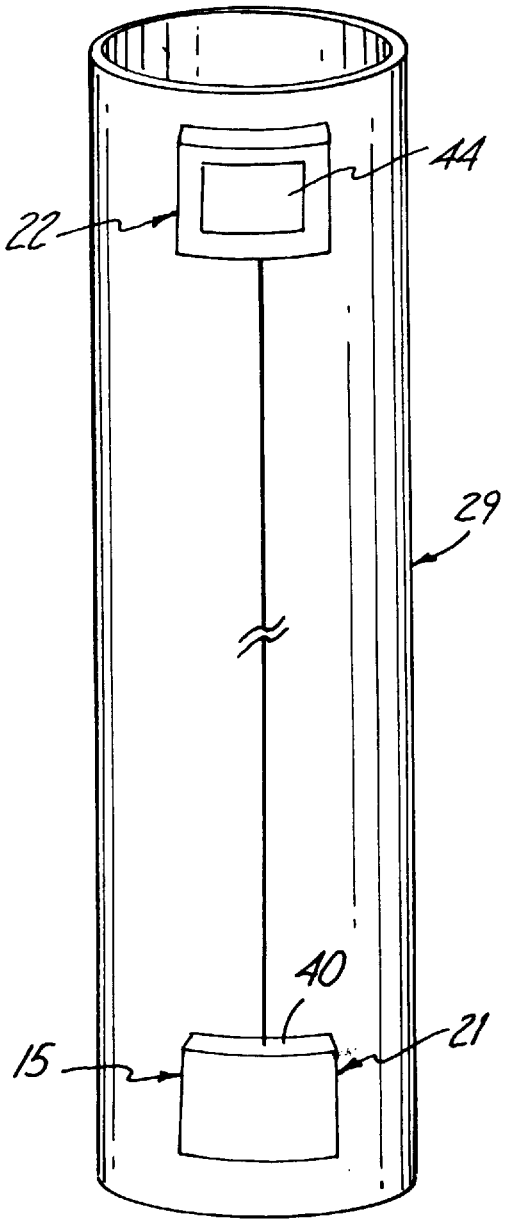
FIG. 2 is one side-view of a sensor mechanism of the golf equipment inventory device of the present invention wherein the device is installed outside of the golf bag.

The sensing mechanism 15 additionally includes, in one embodiment, a microprocessor 44 for converting the unique magnetic media strip 17 or 58 into a club identification and for storing this information. The information is then transmitted to the readout 22. In one other embodiment illustrated in FIG. 2, a microprocessor 44 is incorporated within the readout 22 only. With this embodiment, the sensing mechanism, 15 transmits the raw magnetic media information code data directly to the readout 22, where it is manipulated and stored by the microprocessor.

The magnetic reader module 21 may be positioned, in one embodiment, within the golf club bag 24, as shown in FIG. 1. It is also contemplated, however, that the magnetic reader module 21 is positioned outside of the bag 24. The magnetic reader module 21 is positioned so that marker 50 is below the module 21 when stored and passes by the module 21 upon golf club removal from the bag 24. The magnetic charge head assembly 40 charges and reads the magnetic media in the golf club 14 as it passes by the mechanism 21.

The magnetic reader module 21 detects removal and return of golf clubs with respect to the bag 24. If the magnetic/charge head assembly 40 is tripped, that is, senses a golf club position, the microprocessor 44 is programmed to search for prior entry of the club into the bag due to detection of the presence of the club by detection of the marker 12. If no prior entry is found, the microprocessor 44 signals to the golfer through the readout 22 that a club 14 is missing from the bag. If a prior entry is found, the microprocessor 44 signals through the readout 22 to the player, that the club has been returned.

The magnetic reader module 21 transmits a signal to the readout 22, which may be mounted on the outside of a bag 24 and is readily visible to the golfer. The readout 22 transmits a warning upon golf club removal to the golfer. The readout 22 signals to the golfer, in one embodiment, the specific club 14 which is missing from the bag 24. In another embodiment, the readout 22 emits an audible signal to the golfer indicating that a club 14 is missing. With this embodiment, the readout 22 does not identify the specific club. Upon replacement of the club 14 into the bag 24 and past the magnetic reader module 21, the readout 22 ceases any alerts.

In one embodiment, the magnetic reader module 21 is affixed within the bag 24. The magnetic reader module 21 is stationary and communicates with the readout 22 via a wire 46. The magnetic reader module 21 and microprocessor 44 are capable of determining whether a single club or multiple clubs have been removed from the bag 24. The magnetic reader module 21 and microprocessor 44 can also determine if one or more clubs removed from the bag has not been returned because of the data storage by the microprocessor 44.

It is contemplated that the inventory device 10 of the present invention may further include an override feature that permits a golfer to ignore the absence of a particular club. The override feature is preprogrammed into the microprocessor 44. A golfer will, in one embodiment, also have a capacity to adjust visual or audio alert intervals provided by the readout 22. It is also contemplated that the inventory device may further include a remote receiver and readout 22, which is worn on the golfer's person, rather than being installed on the bag 24, in order to minimize possible distraction to other golfers. With this embodiment, the receiver and readout 22 may include a vibration mode, rather than an audio mode, or in addition to an audio or visual mode, to signal to the golfer that a club 14 is no longer in the bag 24. The remote readout 22 receives signals telemetrically from the sensor mechanism 15. The microprocessor 44 may be used to permit a golfer to optionally select an alert modality, i.e. an audio, visual or vibratory signal. The golfer may also select the duration of the signal, a snooze option and so one.

It is also contemplated that the inventory device of the present invention includes an option whereby the golfer may specify the number of clubs for which the inventory device will account. This feature permits golfers who carry more clubs than regulations allow to maintain an inventory of their clubs. This feature is also preprogrammed into the microprocessor 44.

The inventory device of the present invention is preferably meant to be customizable by each golfer and to allow for customization of golf club identification. This customization may be accomplished by an additional device which specifically encrypts or formulates a specific magnetic signal for each golfer. With this embodiment, golf clubs are encoded not only on a club basis but on a golfer identity basis as well.

The aforementioned description is not be interpreted to exclude other golf equipment inventory devices advantageously employing the present invention. Other arrangements may be devised by those skilled in the art without departing from the spirit and scope of the present invention.

What is claimed is:

1. A device positionable on a golf bag for monitoring golf club presence in the bag, comprising:

a marker mechanism positionable in a grip shaft of the golf club, the marker mechanism including an identification medium unique to a particular golf club wherein the marker includes one or more teeth for positioning the marker within a golf club shaft and wherein the marker teeth are made of a reversibly deformable material;

a sensing mechanism for sensing position of the golf club with respect to the golf bag thereby indicating club presence in the bag by sensing a change with respect to the marker; and a readout mechanism capable of receiving a signal from the sensing mechanism and capable of notifying a golfer as the status of clubs presence.

2. The device of claim 1 and further including a microprocessor for determining when a golf club has been removed from the golf bag and for determining when a golf club has been returned to the golf bag.

3. The device of claim 1 wherein the readout emits a signal to the golfer when one or more clubs are removed from the bag.

4. The device of claim 1 wherein the marker mechanism includes magnetic media having a unique identification.

5. The device of claim 1 wherein each of the return mechanism and removal mechanism include a sensor for sensing a change in position in the magnetic media of each golf club marker.

6. The device of claim 1 wherein the readout receives signals from the sensor mechanism telemetrically.

7. The device of claim 1 wherein the readout provides a vibratory signal to a golfer.

8. The device of claim 1 wherein the removal sensing mechanism and the return sensing mechanism are a single mechanism.

9. A marker device positionable in a grip shaft of a golf club for identifying the golf club to a sensor, the device comprising:

a retaining component for retaining the marker device in the grip shaft;

a shaft component attached to the retaining component;

wherein the retaining component and the shaft component are made of a reversibly deformable material; and media containing information that identifies the golf club to a sensor.

10. The marker of claim 9 wherein the media is magnetic media.

11. A golf club comprising a head, a shaft and a grip wherein a marker mechanism is positioned in the grip of the golf cub, the marker mechanism including an identification medium unique to the golf club.

12. A device positionable on a golf bag for monitoring golf club presence in the bag, comprising:

a marker mechanism positioned in a grip component of the golf club, the marker mechanism including an identification medium unique to the particular golf club;

a sensing mechanism for sensing position of the golf club with respect to the bag thereby indicating club presence in the bag by sensing a change with respect to the marker; and a readout mechanism capable of receiving a signal from the sensing mechanism and capable of notifying a golfer as to the status of a club presence.

* * * * *

UNITED STATES PATENT AND TRADEMARK OFFICE

CERTIFICATE OF CORRECTION

PATENT NO. : 5,844,483
DATED : Dec. 1, 1998
INVENTOR(S) : Jeffrey V. Boley

It is certified that error appears in the above-indentified patent and that said Letters Patent is hereby corrected as shown below:

Col. 2, line 36, after the word "a", delete the word "the".

Col. 3, line 5, after the word "mechanism", delete the punctuation mark ",".

Col. 4, line 3, after the word "so", delete the word "one", and insert the word -- on -- .

Col. 4, line 19, after the word "not", insert the word -- to -- .

Col. 4, line 41, after the word "as", insert the word -- to -- .

Col. 5, line 9, after the word "golf", delete the word "cub" and insert the word -- club -- .

Signed and Sealed this

Thirtieth Day of March, 1999

*Attest:*

*Attesting Officer*

Q. TODD DICKINSON

*Acting Commissioner of Patents and Trademarks*